US005240157A

United States Patent [19]

Selhost

[11] Patent Number: 5,240,157

[45] Date of Patent: Aug. 31, 1993

[54] BACKPACK HARNESS AND CINCH

[75] Inventor: Dale L. Selhost, Moline, Ill.

[73] Assignee: Litton Systems, Inc., Davenport, Iowa

[21] Appl. No.: 883,551

[22] Filed: May 15, 1992

[51] Int. Cl.[5] ..... A45F 3/04

[52] U.S. Cl. ..... 224/215; 224/216; 24/170; 24/265 BC

[58] Field of Search ..... 224/209, 210, 211, 212, 224/213, 214, 215, 216, 261, 262, 259; 24/170, 193, 265 BC

[56] References Cited

U.S. PATENT DOCUMENTS

| | | | |
|---|---|---|---|
| 55,933 | 6/1866 | Thompson . | |
| 317,231 | 5/1885 | Smith . | |
| 843,987 | 2/1907 | Balliett . | |
| 1,338,850 | 5/1920 | Bear . | |
| 1,697,833 | 1/1929 | Lane . | |
| 3,038,644 | 6/1962 | Johnson . | |
| 3,442,427 | 5/1969 | Arnell et al. | 224/261 |
| 4,378,921 | 4/1983 | Allen et al. . | |
| 4,484,379 | 11/1984 | Appelt et al. . | |

FOREIGN PATENT DOCUMENTS

| | | | |
|---|---|---|---|
| 84398 | 3/1977 | Australia | 224/215 |
| 2079833 | 1/1982 | United Kingdom . | |

*Primary Examiner*—Linda J. Sholl
*Attorney, Agent, or Firm*—Brian L. Ribando

[57] ABSTRACT

A harness assembly for a backpack includes a pair of straps, a pair of right angle cinch rings, and a buckle. The right angle cinch rings allow the straps to be tightened on the chest of the wearer by pulling on the strap ends which are around the wearer's waist and fastening the buckle. The right angle cinch rings maintain the tightness of the straps on the wearer's chest when the buckle is loosened, preventing the pack from sliding down the wearer's back.

10 Claims, 3 Drawing Sheets

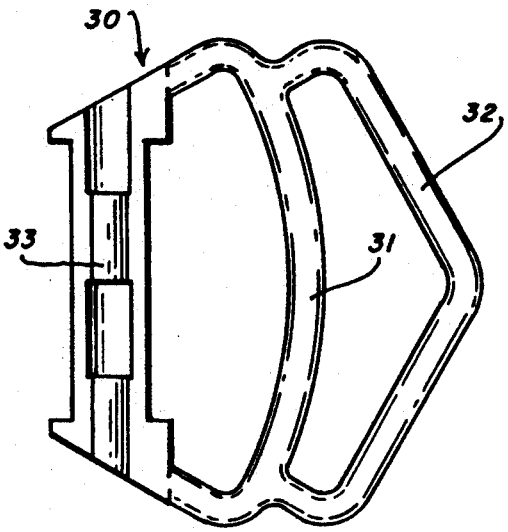
Fig_3
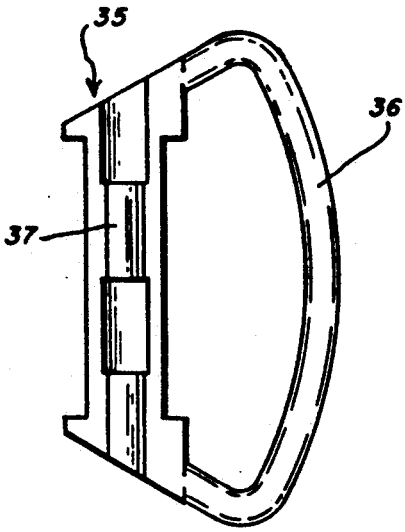
Fig_4
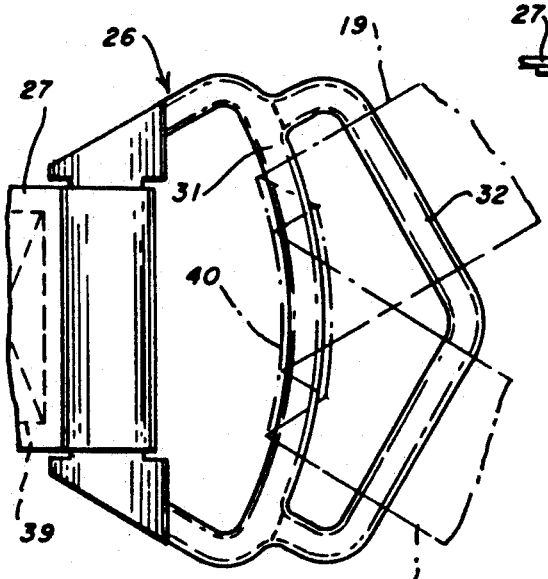
Fig_5
Fig_6
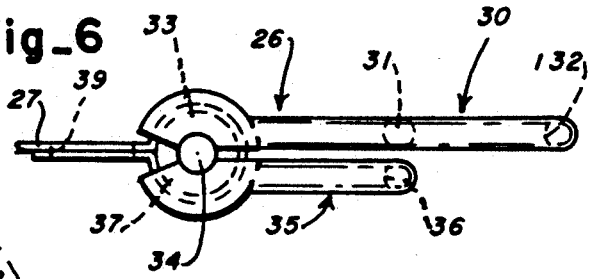
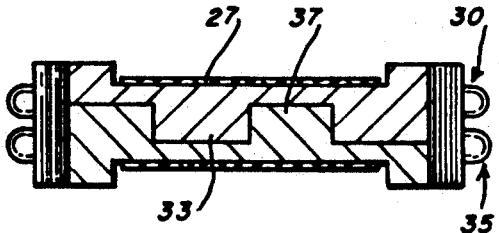
Fig_7

BACKPACK HARNESS AND CINCH

BACKGROUND OF THE INVENTION

The invention relates to a harness and cinch assembly for use with a backpack.

Backpacks are worn by hikers to carry camping gear, by soldiers to carry survival gear, and by rescue workers to carry emergency equipment. Backpacks are usually attached to a wearer by a harness assembly comprising an array of straps which secures the backpack frame to the wearer's back. With a well-designed harness assembly, the straps support the backpack at the proper height on the wearer's body and hold the lower portion of the pack against the small of the wearer's back. In order to accomplish this, the harness straps are attached to the upper and lower portions of the backpack frame and pass over the wearer's shoulders and chest and around the waist.

A typical prior art configuration is shown in published British Patent Application No. 2079833A, published Jan. 27, 1982. A first pair of straps pass over the wearer's shoulders and down the chest; and a second pair of straps encircle the wearer's waist. A buckle is used to clasp the waist straps together and includes loops which receive the chest straps. Since the chest straps are attached to the buckle, when the buckle is undone, the chest straps are loose: and the backpack is free to slide down the wearer's back. This is undesirable since before the buckle is secured, the pack is not adequately supported on the wearer's back; and when the buckle is loosened to remove the pack, the shifting weight can throw the wearer off balance, making final removal of the pack difficult. It is advantageous, especially when the backpack contains life-saving or other emergency equipment, that the pack be able to be put on and taken off quickly and with a minimum of effort. To this end, it is desirable to minimize the number of buckles and clasps which are used to secure the pack to the wearer and to be able to adjust the position of the pack on the wearer's back by pulling a single pair of straps which can be secured with a buckle around the wearer's waist. It is further desirable to be able to loosen the buckle in preparation for removing the pack without having the pack slide down the wearer's back at the same time.

SUMMARY AND OBJECTS OF THE INVENTION

According to the invention, a harness and cinch ring assembly for a backpack includes a single pair of straps each having a shoulder portion, chest portion, and a waist portion. The waist portion of the straps terminate in a buckle assembly which can be snapped together or separated with a minimum amount of complication. The chest portion and waist portion of the straps meet in a bend which is formed around a loop of a right angle cinch ring. The cinch ring allows the chest portion of the straps to be tightened on the wearer's chest by pulling on the waist portion. However, the chest portion of the straps remain tight although the waist portion is loosened when the wearer opens the buckle prior to removing the pack.

It is, accordingly, an object of the invention to provide a harness and cinch ring mechanism for securing a backpack to a wearer.

It is another object of the invention to provide a right angle cinch ring in a harness assembly for a backpack which allows the chest portion of harness straps to be tightened by pulling on the waist portion of the straps.

It is another object of the invention to provide a right angle cinch right which maintains tension on the chest portion of a pair of backpack straps although the waist portion is loosened. These and other objects of the invention will become apparent from the following detailed description in which reference numerals used throughout the description correspond to those shown on the drawing figures.

BRIEF DESCRIPTION OF THE DRAWINGS

FIG. 3 shows the double loop portion of a right angle cinch ring.

FIG. 4 shows the single loop portion of a right angle cinch ring.

FIG. 5 is a plan view of a right angle cinch ring.

FIG. 6 is a side view of the right angle cinch ring of FIG. 5.

FIG. 7 is a sectional view showing the mated pivot portions of the right angle cinch ring.

DESCRIPTION OF THE PREFERRED EMBODIMENT

Figure 2:
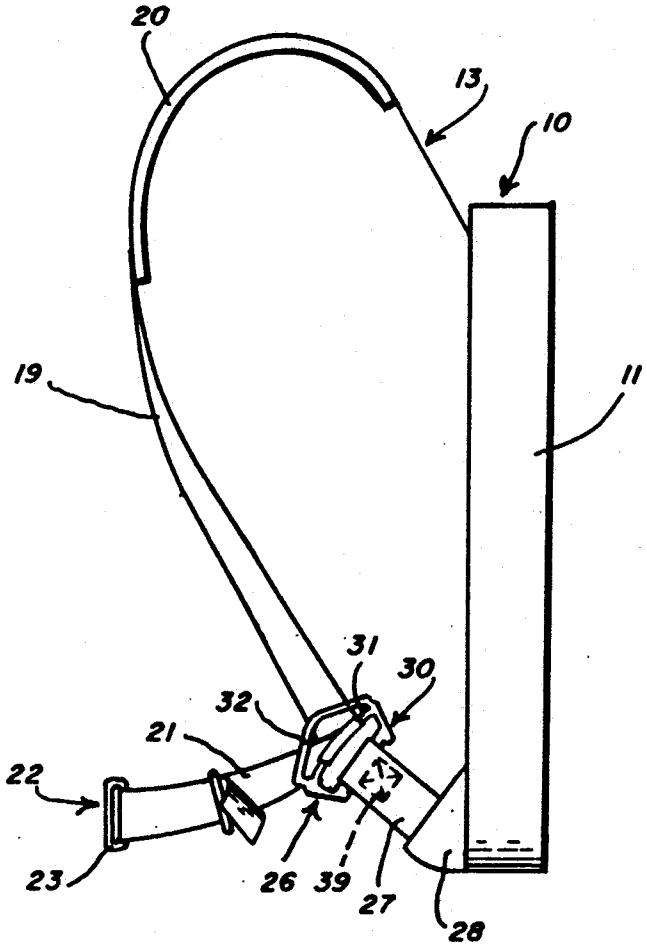
FIG. 2 is a side view of the backpack of FIG. 1.
Figure 1:
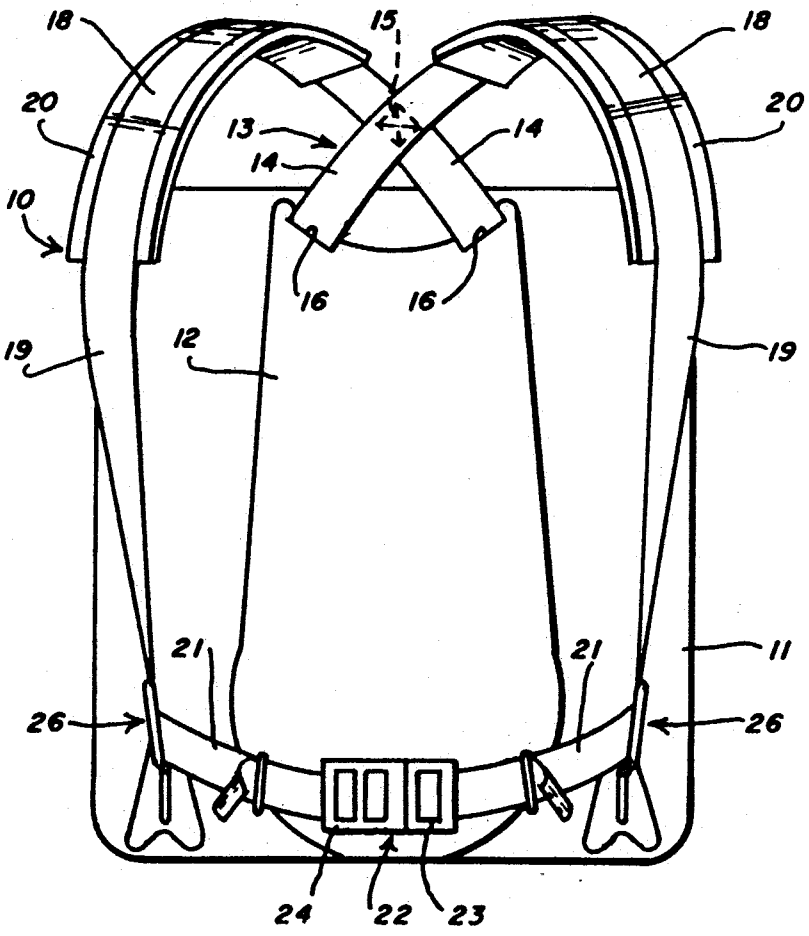
FIG. 1 is a front view of a backpack and harness assembly.

Turning now to FIGS. 1 and 2, there is shown a backpack assembly generally indicated by the reference numeral 10. The assembly includes a backpack having a frame portion 12, and a harness 13. The harness 13 includes a pair of straps 14 which are joined to the frame at upper mounting points 16. The straps 14 are fastened together at junction 15, and each strap includes a shoulder portion 18, a chest portion 19, and a waist portion 21. A cushion or shoulder pad 20 may be provided on each shoulder portion 18 for the wearer's comfort. The waist portions 21 may be coupled together by a buckle 22, comprising a male portion 23 and a female portion 24. It will be understood that the shoulder portion, chest portion, and waist portion of each of the straps 14 are all part of one continuous strap and are referred to by the various terms for ease of reference only. The lower end of the chest portion 19 of each strap 14 is threaded through a right angle cinch ring 26 which is attached by a linking strap 27 to a lower mounting point 28 of the backpack frame 12. The term "right angle cinch ring" derives from the angle formed between the chest portion 19 and the waist portion 21 of the strap 14 as it passes through the cinch ring 26.

FIGS. 3–7 show the right angle cinch ring 26 in greater detail. FIG. 3 shows the double loop ring 30 comprising an inner loop 31, an outer loop 32 and a pivot portion 33. The inner loop 31 describes an arc of between 50 and 90 degrees and is preferably 60 degrees. The length of the arcuate portion of the loop 31 must be long enough to accommodate the dimension of the strap 14 which wraps around it; and when a strap 1.5 inches wide is used, the loop 31 is between 2.2 and 3.9 inches long. FIG. 4 shows a single loop ring 35 comprising a single loop 36 and a pivot portion 37. The single loop 36 describes an arc of between 50 and 90 degrees and is preferably 60 degrees. The length of the arcuate portion of the loop 36 is between 2.2 inches and 3.9 inches and is chosen to correspond to the length of the inner loop 31 of the double loop ring 30. FIGS. 5 and 6 show the double loop ring 30 and the single loop ring 35 joined together along their respective pivot portions 33 and 37. The linking strap 27 is folded around the pivot portions 33 and 37 and is stitched together at 39 in order to hold the two rings 30 and 35 together while still allowing relative pivoting motion around a pivot axis 34, best seen in FIG. 6. The spacing between the inner loop 31 and the pivot portion 33 of the double loop ring 30 is equal to the spacing between the single loop 36 and the pivot portion 37 of the single loop ring 35.

FIG. 7 shows the mated pivot portions of the double loop ring 30 and the single loop ring 35. Each ring is formed with lands and grooves which interfit with one another to allow pivoting of the rings around the pivot axis 34 but prevent lateral displacement as long as the pivot portions are held in intimate contact by the surrounding linking strap 27.

Figure 8:
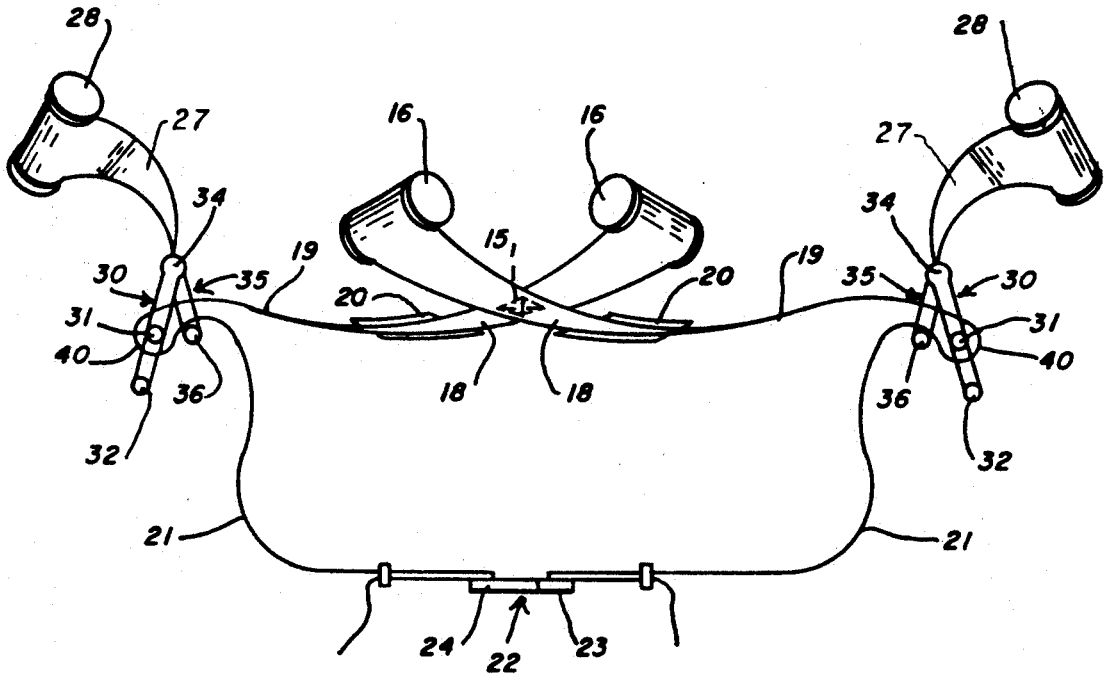
FIG. 8 is a schematic showing the path of the webbing through the cinch rings and the buckle of a backpack harness assembly.

FIG. 8 shows a schematic of the straps 14, the right angle cinch rings 26, and the buckle 22 which form the completed harness assembly. As shown, the chest portion 19 of each strap 14 passes between the pivot axis 34 and single loop 36 of the single loop ring and between the pivot axis 34 and the inner loop 31 of the double loop ring and forms a bend 40 around the inner loop 31 of the double loop ring where it meets the waist portion 21 which passes between the pivot axis 34 and the single loop 36 of the single loop ring and between the outer loop 32 and the inner loop 31 of the double loop ring. The right angle cinch rings 26 are each positioned on the backpack by the linking straps 27 so that the single loop ring 35 is located between the double loop ring 30 and the wearer's body.

METHOD OF OPERATION OF THE PREFERRED EMBODIMENT

In use, the wearer places his arms through the shoulder portions 18 with the shoulder pads 20 roughly in alignment with the tops of the wearer's shoulders. Tension on the waist portion 31 of the straps tightens the bends 40 drawing the double loop ring 30 against the single loop ring 35 and capturing the straps between the loops 31 and 36. At the same time, the chest portions 19 pull through the right angle cinch rings 26 raising the backpack into the proper position on the wearer's back. Further tension on the waist portions 21 draws the lower portion of the backpack against the small of the wearer's back and coupling the halves of the buckle 22 together secures the pack in the desired position on the wearer's body. When it is desired to remove the backpack, the buckle 22 is loosened releasing the two waist portions 21. The tension on the chest straps 19 caused by the weight of the pack pulls on the bend 40 and keeps the strap locked between the loops 31 and 36. This prevents elongation of the chest portion 19 and maintains the backpack in position on the wearer's back. The wearer can then slip his arms out of the shoulder portions 18 of the straps in order to remove the pack from his back. If it is desired to loosen the chest portions 19 of the straps before removing the backpack, an outward force on the outer loop 32 of the double loop ring 30 will separate the two loops 31 and 36 and allow the waist portion 21 of the straps to slip through the cinch ring 26, elongating the chest portions 19.

Having thus described the invention, various modifications and alterations will occur to those skilled in the art, which modifications and alterations are intended to be within the scope of the invention as defined by the appended claims.

What is claimed is:

1. A backpack harness for securing a backpack on the back of a wearer comprising:

a pair of straps each having first ends attached to the frame portion of a backpack and second ends attached to the mating halves of a buckle, each strap having a shoulder portion, a chest portion and a waist portion;

a cinch ring means attached to each strap between the chest portion and the waist portion for guiding the strap between the chest portion and the waist portion and for locking the strap to prevent the waist portion from passing through the cinch ring means to elongate the chest portion;

a pair of rings comprising each cinch ring means; and a linking strap coupling each cinch ring means to a lower region of the backpack.

2. The backpack harness of claim 1 wherein the pair of rings comprise a double loop ring having an outer loop, an inner loop, and a pivot portion, and a single loop ring having a loop and a pivot portion.

3. The backpack harness of claim 2 wherein the spacing between the pivot portion and the inner loop of the double loop ring is equal to the spacing between the pivot portion and the loop of the single loop ring.

4. The backpack harness of claim 3 wherein the pivot portion of the double loop ring and the single loop ring interfit with one another and are held together by the linking strap, whereby the inner loop of the double loop ring and the loop of the single loop ring are adjacent one another.

5. The backpack harness of claim 4 wherein the inner loop of the double loop ring and the loop of the single loop ring each describe an arc of between 50 and 90 degrees.

6. The backpack harness of claim 5 wherein the arc is 60 degrees.

7. The backpack harness of claim 6 wherein the chest portion and the waist portion of each strap each pass between the pivot axis and the loop of the single loop ring and meet in a bend formed around the inner loop of the double loop ring.

8. The backpack harness of claim 7 wherein the linking straps position each cinch ring relative to the body of the wearer with the single loop ring between the said body and the double loop ring.

9. The backpack harness of claim 8 wherein the position of the cinch rings and the path of the straps through the rings cause the chest portions of the straps to tighten when the waist portions are pulled and the chest portions to remain tight when the waist portions are released.

10. The backpack harness of claim 9 wherein the chest portions of the straps are loosened when the double loop ring is pivoted away from the single loop ring.

* * * * *